US007237672B1

(12) United States Patent
Governale et al.

(10) Patent No.: US 7,237,672 B1
(45) Date of Patent: Jul. 3, 2007

(54) RADIATION BAG SYSTEM

(76) Inventors: John T. Governale, 4620 SE. 24th St., Ocala, FL (US) 34471; Dan Young, 501 S. Andreasen Dr., Escondido, CA (US) 92029

( * ) Notice: Subject to any disclaimer, the term of this patent is extended or adjusted under 35 U.S.C. 154(b) by 139 days.

(21) Appl. No.: 10/817,280

(22) Filed: Apr. 2, 2004

(51) Int. Cl.
*B65D 85/38* (2006.01)
*B65D 85/84* (2006.01)
*B65D 30/02* (2006.01)
*B65D 30/10* (2006.01)
*B65D 30/22* (2006.01)

(52) U.S. Cl. ..... 206/305; 206/524.1; 383/121; 383/40

(58) Field of Classification Search ..... 206/524.1, 206/527, 305, 484; 383/6–31, 78, 81, 98, 383/99, 120, 907, 38, 40, 125, 126, 114, 906, 383/127, 121; 229/87.01, 87.03, 87.04; 428/35.2; 374/158, 209; 150/154, 161, 165; 396/25, 396/27; 359/511; D9/711, 713, 702, 703, D9/444; 600/121–125, 186, 203; 2/158
See application file for complete search history.

(56) References Cited

U.S. PATENT DOCUMENTS 2,349,247 A * 5/1944 Coghill ..... 383/93
2,913,030 A * 11/1959 Fisher ..... 206/317
3,318,505 A * 5/1967 Garrison et al. ..... 229/103.1
4,943,167 A * 7/1990 Gelbard ..... 383/8
5,168,863 A * 12/1992 Kurtzer ..... 600/122
5,196,244 A * 3/1993 Beck ..... 428/35.2
5,503,477 A * 4/1996 Schlough ..... 383/207
D369,607 S * 5/1996 MacGilvary et al. ..... D14/250
5,807,107 A * 9/1998 Bright et al. ..... 433/116
5,968,000 A * 10/1999 Harrison et al. ..... 602/41
6,000,400 A * 12/1999 Navis ..... 128/849
6,082,535 A * 7/2000 Mitchell ..... 206/320
6,174,280 B1 * 1/2001 Oneda et al. ..... 600/121
6,547,744 B1 * 4/2003 Pompei et al. ..... 600/549
6,921,203 B2 * 7/2005 Versluys ..... 383/104
2003/0223655 A1 * 12/2003 Faygenov ..... 383/63
2004/0140028 A1 * 7/2004 Clark et al. ..... 150/154
2005/0199818 A1 * 9/2005 Tomita et al. ..... 250/370.01

* cited by examiner

*Primary Examiner*—Mickey Yu
*Assistant Examiner*—J. Gregory Pickett
(74) *Attorney, Agent, or Firm*—Edward P. Dutkiewicz

(57) ABSTRACT

A radiation bag system comprising a major body portion in a generally rectangular configuration including a linear bottom edge and a parallel linear top edge with perpendicular side edges there between. The side edges include a discontinuous side edge and a parallel continuous side edge. A minor handle portion in a generally rectangular configuration includes a linear bottom edge and a parallel linear top edge with perpendicular side edges there between. The body portion and handle portion are fabricated of a flexible sheet material with an upper sheet and a congruent lower sheet coupled along the upper edge of the handle portion and the lower edge of the body portion. The upper sheet and lower sheet are also coupled along the discontinuous edge. The sheets are thus adapted to form a major chamber in the body portion. The sheets are thus also adapted to form a minor chamber in the handle portion.

6 Claims, 3 Drawing Sheets

RADIATION BAG SYSTEM

BACKGROUND OF THE INVENTION

1. Field of the Invention

The present invention relates to a radiation bag system and more particularly pertains to protecting a sensitive radiation detecting device from "contamination" by nuclear fission byproducts.

2. Description of the Prior Art

The use of plastic bags and shields is known in the prior art. More specifically, plastic bags and shields previously devised and utilized for the purpose of shielding users from the contents of plastic bags and containers are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,058,479 issued Nov. 15, 1977 to White relates to a filter-lined container for hazardous solids. U.S. Pat. No. 4,923,436 issued May 8, 1990 to Gelbard relates to a plastic bag and method and apparatus of manufacture. U.S. Pat. No. 5,800,887 issued Sep. 1, 1998 to Koyama relates to a oxygen-absorbing container. U.S. Pat. No. 5,966,741 issued Oct. 19, 1999 to Klecina relates to a stacked disposable plastic glove pad. U.S. Pat. No. 6,042,909 issued Mar. 28, 2000 to Dunleavy relates to an encapsulation device. Lastly, U.S. Pat. No. 6,149,699 issued Nov. 21, 2000 to White relates to a method and apparatus relating to disposable filter modules for filtering air containing hazardous substances.

While these devices fulfill their respective, particular objectives and requirements, the aforementioned patents do not describe a radiation bag system that allows protecting a sensitive radiation detecting device from being "contaminated" by nuclear fission byproducts.

In this respect, the radiation bag system according to the present invention substantially departs from the conventional concepts and designs of the prior art, and in doing so provides an apparatus primarily developed for the purpose of protecting a sensitive radiation detecting device from "contamination" by nuclear fission byproducts.

Therefore, it can be appreciated that there exists a continuing need for a new and improved radiation bag system which can be used for protecting a sensitive radiation detecting device from "contamination" by nuclear fission byproducts. In this regard, the present invention substantially fulfills this need.

SUMMARY OF THE INVENTION

In view of the foregoing disadvantages inherent in the known types of plastic bags and shields now present in the prior art, the present invention provides an improved radiation bag system. As such, the general purpose of the present invention, which will be described subsequently in greater detail, is to provide a new and improved radiation bag system and method which has all the advantages of the prior art and none of the disadvantages.

To attain this, the present invention essentially comprises a radiation bag system for protecting a sensitive radiation detecting device from "contamination" by nuclear fission byproducts. The system comprises, in combination, a major body portion in a generally rectangular configuration including a linear bottom edge and a parallel linear top edge with perpendicular side edges there between. The side edges include a closed discontinuous side edge and an open parallel continuous side edge.

A minor handle portion in a generally rectangular configuration includes a linear bottom edge and a parallel linear top edge with perpendicular side edges there between.

An elongated recess extends inwardly from adjacent to the discontinuous side edge toward the continuous side edge. The recess is of a length essentially equal to half the length of the bottom edge of the body portion. The recess has a top edge coextensive with the bottom edge of the handle portion. The recess has a bottom edge coextensive with the top edge of the body portion. The recess terminates with a C-shaped end.

An elongated intermediate portion couples the body portion and the handle portion. The intermediate portion extending from the C-shaped end of the recess to the continuous side edge. The recess and the intermediate portion are in substantial linear alignment parallel with the bottom edge of the body portion.

The body portion and handle portion and intermediate portion are fabricated of a flexible transparent polyethylene sheet material with an upper sheet and a congruent lower sheet. Such sheets are coupled along the upper edge of the handle portion and the lower edge of the body portion. The upper sheet and lower sheet are also coupled along the upper and lower edges and along the C-shaped end of the recess. The sheets thus adapted to form a major chamber in the body portion for a radiation detecting device. The sheets are thus also adapted to form a minor chamber in the handle portion for the handle of a radiation detecting device. The sheets are thus also adapted to form an intermediate chamber in the intermediate portion for a riser coupling a radiation detecting device to its handle.

A pleat is fabricated of a flexible transparent polyethylene sheet material. Such material is folded to form a pleat line at an interior edge and extending to an exterior edge and coupling with the discontinuous side edges of the body and handle portions. The pleat also has parallel edges coupling with the top and bottom edges of the handle portion and coupling with the top and bottom edges of the body portion. The pleat is adapted to close the chambers when a radiation detecting device is inserted into the body and handle portion through the continuous side edge.

Lastly, a closure mechanism holds shut at least one side edge of the body portion when the radiation detecting device is contained within the body, handle and intermediate portions during operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved radiation bag system which has all of the advantages of the prior art plastic bags and shields and none of the disadvantages.

It is another object of the present invention to provide a new and improved radiation bag system which may be easily and efficiently manufactured and marketed.

It is further object of the present invention to provide a new and improved radiation bag system which is of durable and reliable constructions.

An even further object of the present invention is to provide a new and improved radiation bag system which is susceptible of a low cost of manufacture with regard to both materials and labor, and which accordingly is then susceptible of low prices of sale to the consuming public, thereby making such radiation bag system economically available to the buying public.

Even still another object of the present invention is to provide a radiation bag system for protecting a sensitive radiation detecting device from "contamination" by nuclear fission byproducts.

Lastly, it is an object of the present invention to provide a new and improved radiation bag system which comprises a major body portion in a generally rectangular configuration. The body portion includes a linear bottom edge and a parallel linear top edge with perpendicular side edges there between. The side edges include a discontinuous side edge and a parallel continuous side edge. A minor handle portion in a generally rectangular configuration includes a linear bottom edge and a parallel linear top edge with perpendicular side edges there between. The body portion and handle portion are fabricated of a flexible sheet material with an upper sheet and a congruent lower sheet coupled along the upper edge of the handle portion and the lower edge of the body portion. The upper sheet and lower sheet are also coupled along the discontinuous edge. The sheets are thus adapted to form a major chamber in the body portion. The sheets are thus also adapted to form a minor chamber in the handle portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
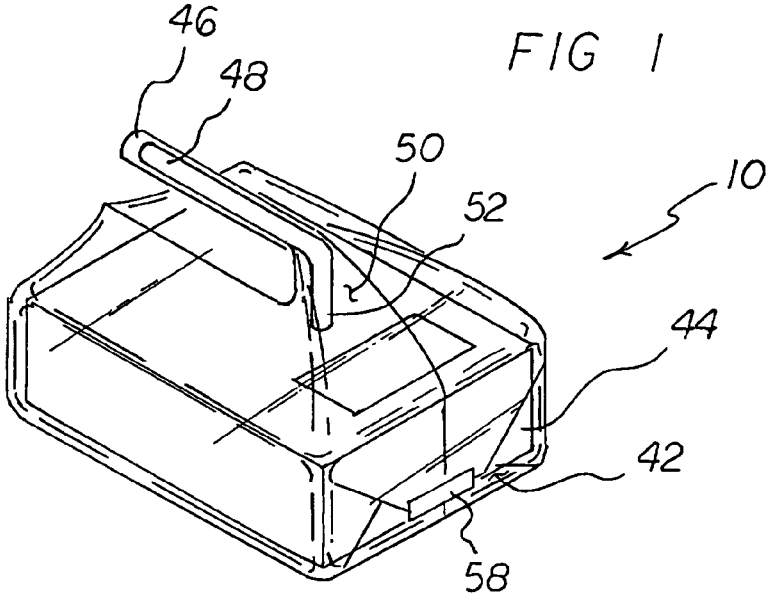
FIG. 1 is a perspective illustration of a radiation bag system constructed in accordance with the principles of the present invention.

With reference now to the drawings, and in particular to FIG. 1 thereof, the preferred embodiment of the new and improved radiation bag system embodying the principles and concepts of the present invention and generally designated by the reference numeral 10 will be described.

The present invention, the radiation bag system 10 is comprised of a plurality of components. Such components in their broadest context include a body portion, a handle portion and a pleat. Such components are individually configured and correlated with respect to each other so as to attain the desired objective.

Figure 2:
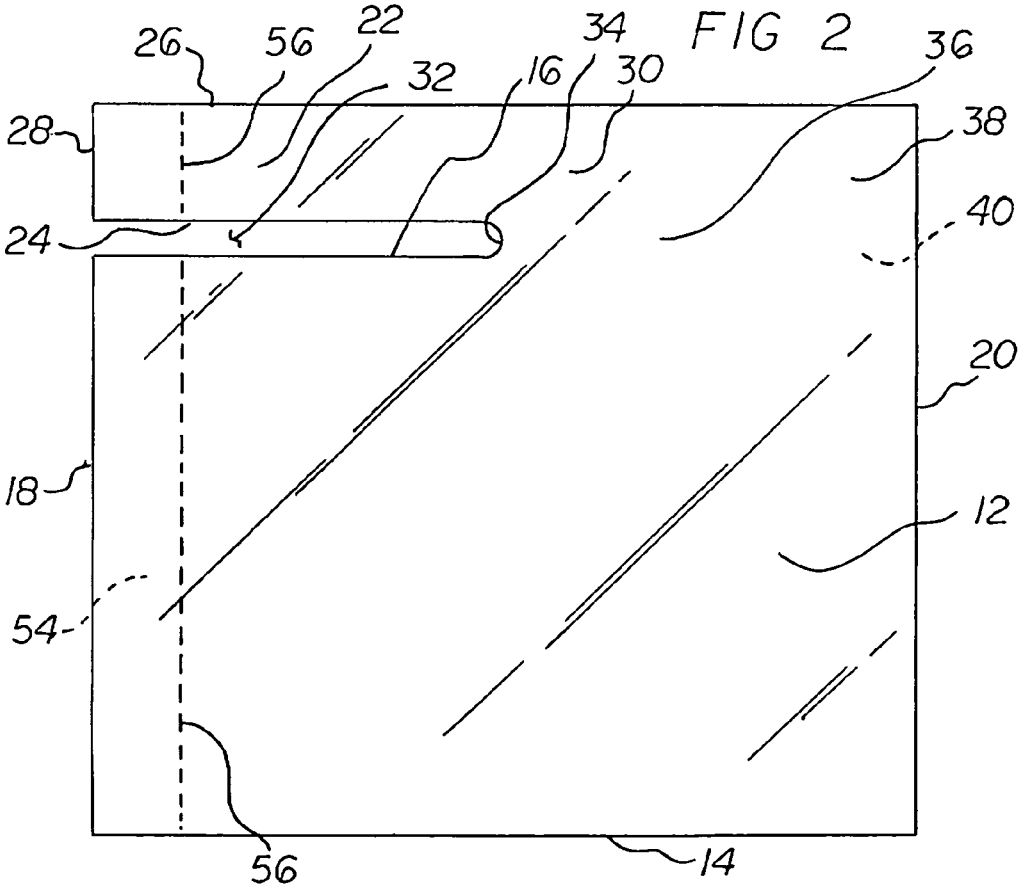
FIG. 2 is a plan view of the bag shown in FIG. 1 but with its contents removed.

The invention is a radiation bag system 10 for protecting a sensitive radiation detecting device from "contamination" by nuclear fission byproducts. The primary embodiment of the system is shown in FIGS. 1 and 2 and comprises, in combination, a major body portion 12 formed in a generally rectangular configuration. The main body portion includes a linear bottom edge 14 and a parallel linear top edge 16 with perpendicular side edges 18, 20 there between. The side edges include a closed discontinuous side edge 18 and an open parallel continuous side edge 20

A minor handle portion 22 in a generally rectangular configuration is next provided. The handle portion includes a linear bottom edge 24 and a parallel linear top edge 26. Perpendicular side edges 28, 30 are formed there between.

Also provided is an elongated recess 32. Such recess extends inwardly from adjacent to the discontinuous side edge. Such recess extends toward the continuous side edge. The recess is of a length essentially equal to half the length of the bottom edge of the body portion. The recess has a top edge coextensive with the bottom edge of the handle portion. The recess also has a bottom edge coextensive with the top edge of the body portion. The recess terminates with a C-shaped end 34.

Next provided is an elongated intermediate portion 36 coupling the body portion and the handle portion. The intermediate portion extends from the C-shaped end of the recess to the continuous side edge. The recess and the intermediate portion are in substantial linear alignment, parallel with the bottom edge of the body portion.

The body portion and handle portion and intermediate portions are fabricated of a flexible transparent plastic material, preferably polyethylene sheet material. Such material includes an upper sheet 38 and a congruent lower sheet 40. Such sheets are coupled along the upper edge of the handle portion and the lower edge of the body portion. The upper sheet and lower sheet also coupled along the upper and lower edges and C-shaped end of the recess. The sheets are thus adapted to form a major chamber 42 in the body portion for a radiation detecting device 44. The sheets are thus also adapted to form a minor chamber 46 in the handle portion for the handle 48 of a radiation detecting device. The sheets are thus also adapted to form an intermediate chamber 50 in the intermediate portion for a riser 52 coupling a radiation detecting device to its handle.

A pleat 54 is fabricated of a flexible transparent polyethylene sheet material. Such material of the pleat is folded to form a pleat line 56 at an interior edge. Such material of the pleat extends to an exterior edge and couples with the discontinuous side edges of the body and handle portions. The pleat also has parallel edges coupling with the top and bottom edges of the handle portion and coupling with the top and bottom edges of the body portion. The pleat is adapted to close the chambers when a radiation detecting device and its handle are inserted into the body and handle portions through the continuous side edge.

Lastly provided is a closure mechanism, preferably a piece of adhesive tape 58. Such tape is for holding shut at least one side edge of the body portion, preferably the continuous side, when the radiation detecting device is contained within the body, handle and intermediate portions during operation and use. In place of the adhesive tape, other types of closure mechanisms could readily be utilized such as hook and loop fasteners, glue, zip lock closures, and the like.

Figure 3:
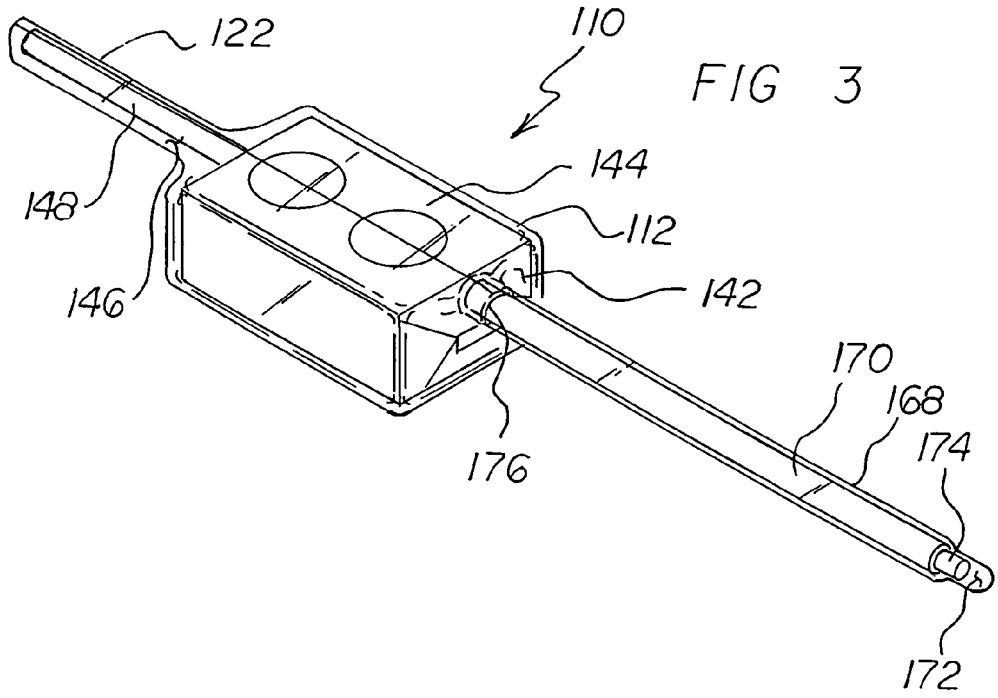
FIG. 3 is a perspective illustration of a radiation bag system constructed in accordance with an alternate embodiment of the invention.
Figure 4:
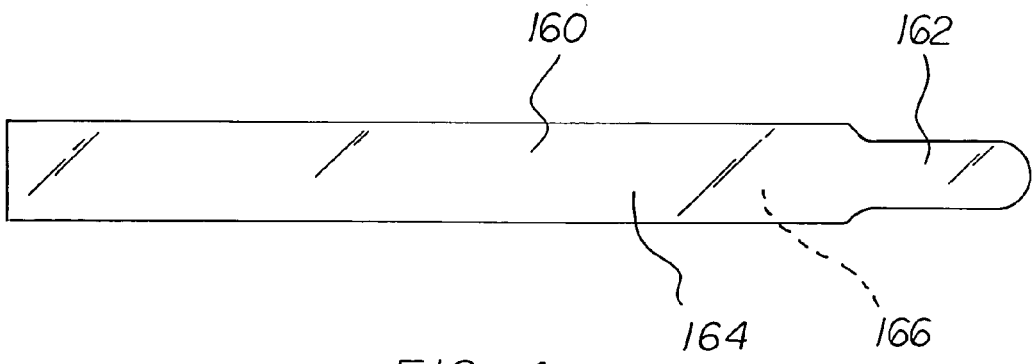
FIG. 4 is a plan view of the primary bag shown in FIG. 3 but with its contents removed.
Figure 5:
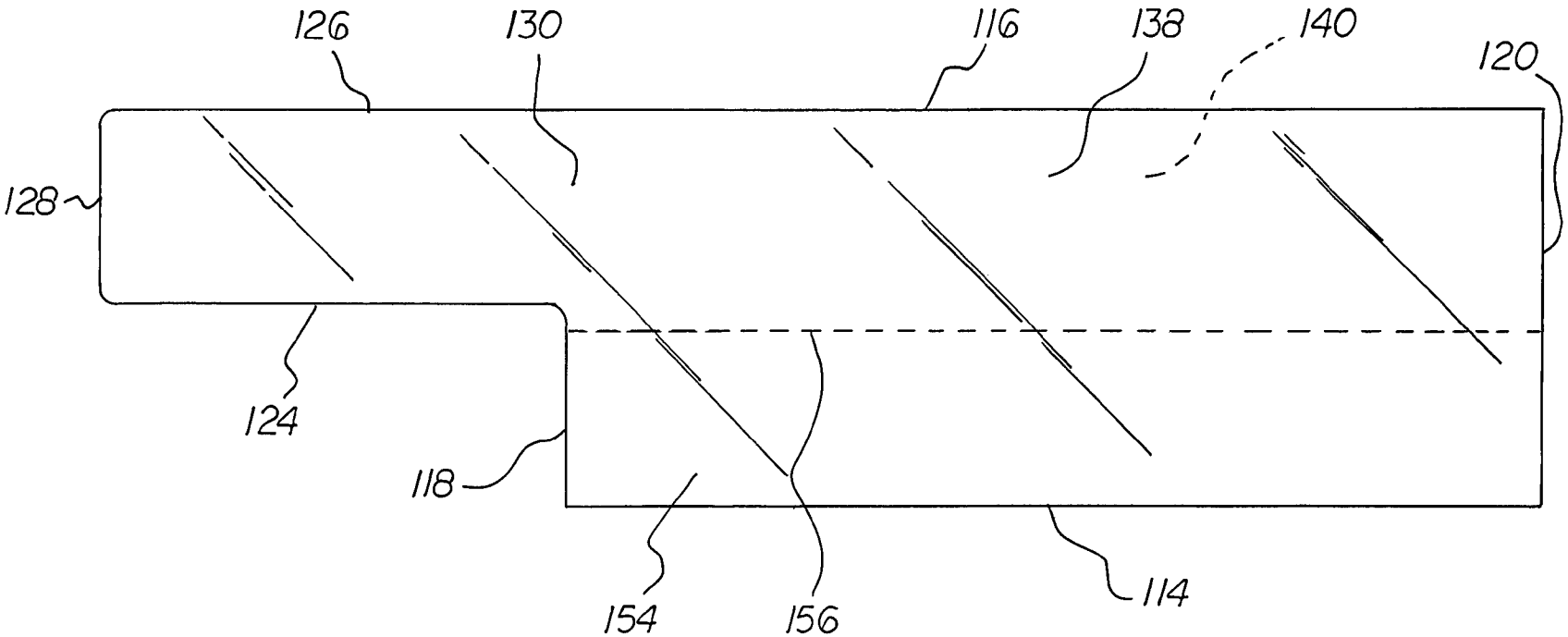
FIG. 5 is a plan view of the secondary bag shown in FIG. 3 but with its contents removed.

An alternate embodiment of the invention is shown in FIGS. 3, 4 and 5. Such embodiment is also a radiation bag system 110 for protecting a sensitive radiation detecting device from "contamination" by nuclear fission byproducts. Such system comprises, in combination, a major body portion 112 in a generally rectangular configuration. The body portion includes a linear bottom edge 114 and a parallel linear top edge 116 with perpendicular side edges 118, 120 there between. The side edges include a closed discontinuous side edge 118 and an open parallel continuous side edge 120.

A minor handle portion 122 in a generally rectangular configuration is next provided. Such handle portion includes a linear bottom edge 124 and a parallel linear top edge 126 formed as an extension of the top edge of the body portion. Perpendicular side edges 128, 130 are formed there between.

The body portion and handle portions are fabricated of a flexible transparent plastic material, preferably polyethylene sheet material. The sheet material includes an upper sheet 138 and a congruent lower sheet 140. Such sheets are coupled along the upper edge of the handle portion and the lower edge of the body portion. The sheets thus adapted to form a major chamber 142 in the body portion for a radiation detecting device 144. The sheets thus are also adapted to form a minor chamber 146 in the handle portion for the handle 148 of a radiation detecting device.

A pleat 154 is fabricated of a flexible transparent polyethylene sheet material. Such sheet material is folded to form a pleat line 156 extending to a lower edge coupling with the bottom edge of the body and portion. The pleat also has parallel edges coupling with the side edges of the body portion, the pleat is thus adapted to close the chambers when a radiation detecting device is inserted into the body and handle portion through the continuous side edge.

Next provided is a secondary cover 160 in a generally rectangular configuration with a projection 162 of a reduced size. The secondary cover being fabricated of a flexible transparent plastic material, preferably polyethylene sheet material. The sheet material includes an upper sheet 164 and a congruent lower sheet 166. Such sheets are coupled along their upper and lower edges and along the projection. Such sheets are uncoupled along the edge opposite from the projection. The sheets are thus adapted to form a major chamber 168 for a radiation probe 170. The sheets are thus also adapted to form a minor chamber 172 in the projection for a tip 174 of the probe. The body portion has a circular aperture 176 for the projection of a probe there through.

Lastly provided is a piece of adhesive tape 158. Such tape is for holding shut the continuous side edge of the body portion when the radiation detecting device is contained within the body and handle during operation and use. As described with respect to the prior embodiment, in place of the adhesive tape, other types of closure mechanisms could readily be utilized such as hook and loop fasteners, glue, zip lock closures, and the like. Further, as another alternate embodiment, the continuous side edge of the plastic material encompassing the radiation detecting device 144 adjacent to the radiation probe 170 may be of an extended length whereby the plastic material encompassing the probe is gathered around the probe and its plastic material and secured with tape. In yet another alternate embodiment, the hole 176 in the continuous side edge of the fabric encompassing the radiation detecting device 144 adjacent to the radiation probe 170 may be eliminated. In place thereof, the adjacent end of the radiation probe 170 and its encompassing plastic material are passed through the opening through which the radiation detecting device was passed and the plastic material encompassing the probe is gathered around the probe and its plastic material and secured with tape.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A radiation bag system for protecting a sensitive radiation detecting device from "contamination" by nuclear fission byproducts comprising, in combination:

a major body portion in a generally rectangular configuration including a linear bottom edge and a parallel linear top edge with perpendicular side edges there between, the side edges including a closed discontinuous side edge and an open parallel continuous side edge;

a minor handle portion in a generally rectangular configuration including a linear bottom edge and a parallel linear top edge with one perpendicular side edge there between;

an elongated recess extending inwardly from adjacent to the discontinuous side edge toward the continuous side edge, the recess being of a length essentially equal to half the length of the bottom edge of the body portion, the recess having a top edge coextensive with the bottom edge of the handle portion, the recess having a bottom edge coextensive with the top edge of the body portion, the recess terminating with a C-shaped end;

an elongated intermediate portion coupling the body portion and the handle portion, the intermediate portion extending from the C-shaped end of the recess to the continuous side edge, the recess and the intermediate portion being in substantial linear alignment parallel with the bottom edge of the body portion;

the body portion and handle portion and intermediate portions being fabricated of a flexible transparent polyethylene sheet material with an upper sheet and a congruent lower sheet coupled along the upper edge of the handle portion and the lower edge of the body portion, the upper sheet and lower sheet also coupled along the upper and lower edges and C-shaped end of the recess, the sheets thus adapted to form a major chamber in the body portion for a radiation detecting device, the sheets thus adapted to form a minor chamber in the handle portion for the handle of a radiation detecting device, the sheets thus adapted to form an intermediate chamber in the intermediate portion for a riser coupling a radiation detecting device to its handle;

a pleat fabricated of a flexible transparent polyethylene sheet material folded to form a pleat line at an interior edge and extending to an exterior edge coupling with the discontinuous side edges of the body and handle portions, the pleat also having parallel edges coupling with the top and bottom edges of the handle portion and coupling with the top and bottom edges of the body portion, the pleat adapted to close the chambers when a radiation detecting device is inserted into the body and handle portion through the continuous side edge; and a closure mechanism for holding shut at least one side edge of the body portion when the radiation detecting device is contained within the body, handle and intermediate portions during operation and use.

2. A radiation bag system for protecting a sensitive radiation detecting device from "contamination" by nuclear fission byproducts comprising, in combination:

a major body portion in a generally rectangular configuration including a linear bottom edge and a parallel linear top edge with perpendicular side edges there between, the side edges including a closed discontinuous side edge and an open parallel continuous side edge;

a minor handle portion in a generally rectangular configuration including a linear bottom edge and a parallel linear top edge formed as an extension of the top edge of the body portion and with one perpendicular side edge there between;

the body portion and handle portion being fabricated of a flexible transparent polyethylene with an upper sheet and a congruent lower sheet coupled along the upper edge of the handle portion and the lower edge of the body portion, the sheets thus adapted to form a major chamber in the body portion for a radiation detecting device, the sheets thus adapted to form a minor chamber in the handle portion for the handle of a radiation detecting device;

a pleat fabricated of a flexible transparent polyethylene sheet material folded to form a pleat line at an upper edge and extending to an lower edge coupling with the bottom edge of the body and portion, the pleat also having parallel edges coupling with the side edges of the body portion, the pleat adapted to close the chambers when a radiation detecting device is inserted into the body and handle portion through the continuous side edge;

a secondary cover in a generally rectangular configuration with a projection of a reduced size, the secondary cover being fabricated of a flexible transparent polyethylene with an upper sheet and a congruent lower sheet coupled along their upper and lower edges and along the projection but uncoupled along the edge opposite from the projection, the sheets thus adapted to form a major chamber for a radiation probe, the sheets thus adapted to form a minor chamber in the projection for a tip of the probe, the body portion having a circular aperture for the projection of a probe there through; and a closure mechanism for holding shut the continuous side edge of the body portion when the radiation detecting device is contained within the body and handle during operation and use.

3. A radiation bag system comprising:

a major body portion in a generally rectangular configuration including a linear bottom edge and a parallel linear top edge with perpendicular side edges there between, the side edges including a closed discontinuous side edge and a parallel open continuous side edge; and a minor handle portion in a generally rectangular configuration including a linear bottom edge and a parallel linear top edge with one perpendicular side edge there between;

the body portion and handle portion being fabricated of a flexible sheet material with an upper sheet and a congruent lower sheet coupled along the upper edge of the handle portion and the lower edge of the body portion, the upper sheet and lower sheet also coupled along the discontinuous edge, the sheets thus adapted to form a major chamber in the body portion, the sheets thus adapted to form a minor chamber in the handle portion.

4. The system as set forth in claim 3 and further including a pleat in the body portion.

5. The system as set forth in claim 2 wherein the handle portion is adjacent to the top edge of the body portion.

6. The system as set forth in claim 3 wherein the handle portion is adjacent to the discontinuous side edge of the body portion.

* * * * *